United States Patent [19]

Franke

[11] Patent Number: 4,983,988

[45] Date of Patent: Jan. 8, 1991

[54] ANTENNA WITH ENHANCED GAIN

[75] Inventor: Ernest A. Franke, Largo, Fla.

[73] Assignee: E-Systems, Inc., Dallas, Tex.

[21] Appl. No.: 273,562

[22] Filed: Nov. 21, 1988

[51] Int. Cl.[5] ..... H01Q 21/00

[52] U.S. Cl. ..... 343/853; 343/836

[58] Field of Search ..... 343/796, 797, 799–814, 343/815–820, 834, 835, 836, 850, 851, 853

[56] References Cited

U.S. PATENT DOCUMENTS

| | | | |
|---|---|---|---|
| 2,867,804 | 1/1959 | Gihring | 343/853 |
| 3,064,212 | 11/1962 | Alford | 333/107 |
| 3,545,001 | 12/1970 | Giller | 343/817 |
| 4,101,836 | 7/1978 | Craig et al. | 325/302 |
| 4,101,901 | 7/1978 | Kommrusch | 343/853 |
| 4,103,304 | 7/1978 | Burnham et al. | 343/853 |
| 4,153,878 | 5/1979 | Osborn | 325/370 |
| 4,170,759 | 10/1979 | Stemple et al. | 325/51 |
| 4,213,132 | 7/1980 | Davidson | 343/814 |
| 4,317,229 | 2/1982 | Craig et al. | 455/277 |
| 4,446,465 | 5/1984 | Donovan | 343/797 |
| 4,519,096 | 5/1985 | Cerny, Jr. | 455/137 |
| 4,814,777 | 3/1989 | Monser | 343/799 |

FOREIGN PATENT DOCUMENTS

| | | | |
|---|---|---|---|
| 1201200 | 2/1986 | Canada . | |
| 0121641 | 9/1979 | Japan | 343/850 |
| 2065376 | 6/1981 | United Kingdom . | |

*Primary Examiner*—Rolf Hille
*Assistant Examiner*—Peter Toby Brown
*Attorney, Agent, or Firm*—Harold E. Meier

[57] ABSTRACT

The present invention will yield enhanced gain over a conventional antenna system by taking advantage of combining directional antennae. In one embodiment, the invention utilizes four 10 dB dipole, vertically-polarized, omni-directional antennae having a reflector added to each one to limit the horizontal beamwidth to 90° and increase the gain to 16 dB. The vertical beamwidth remains at 7°. By utilizing four of these antennae and utilizing power combining hybrids to connect each of the two opposed antennae together, excess gain over a 10 dB omni-directional system will be obtained. The effective antenna gain is equal to the directional antenna gain minus the omni-directional antenna gain minus the hybrid loss. Thus, the vertical beamwidth and physical height of the antenna are preserved with the increase in gain at the cost of a little antenna complexity.

6 Claims, 4 Drawing Sheets

ANTENNA WITH ENHANCED GAIN

TECHNICAL FIELD

The present invention relates generally to antenna systems and, in particular, to combined directional antennae having increased effective received signal power while maintaining a wide vertical beamwidth and a limited physical height.

BACKGROUND OF THE INVENTION

Omni-directional antennae are in wide use in communication systems. In such systems, there is an attempt to maximize antenna gain in order to maximize the carrier-to-noise ratio and carrier-to-interference ratio. One method of maximizing omni-directional antenna gain is to stack dipoles in a collinear manner. There are, however, two limitations which must be considered when maximizing antenna gain by stacking dipoles in a collinear manner.

The first limitation is created by physical problems associated with the antenna. It is well known that the power gain of an omni-directional, collinear antenna varies directly with the length of the radiator. Thus, the longer the antenna, the greater the gain. However, simply increasing the length of the antenna to achieve the gain creates other problems. The Federal Communications Commission Rules require aircraft warning lighting on any antenna, itself, that extends more than twenty feet above the top of a tower, building or water tower. Thus, to achieve greater gain, decoupling networks would be required as well as a side ladder for changing the required lights. The additional length, then, creates both electrical and mechanical problems which are not easily solved without greater expenses being required. As the length of the antenna is increased, the physical strength of the antenna must be increased to account for the increased loading under wind loading conditions due to the longer lever arm.

The second limitation on achieving higher gain by stacking dipoles is the compression of the vertical beamwidth as the antenna is increased in length and the gain is increased. The beamwidth decreases by a factor of 2 to achieve each increase in antenna gain of 3 dB. As the beam narrows the criticality of mounting and of maintaining the exact perpendicular position of the antenna, even under wind loading, becomes very important. For a 10 dBd gain antenna, a movement of as slight as $3\frac{1}{2}°$ under high wind conditions, would cause a loss in signal level of 3 dB. It is apparent that such a higher gain antenna must be built more rugged, thus requiring heavier material to be used, in order to form more substantial towers for maintaining the antenna in a fixed position at all times. Further, as the beamwidth narrows, the dead zone or cone of silence beneath the antenna increases. This produces more dead spots. Further, phasing harnesses become more critical as the number of stacked elements increase.

The present invention overcomes disadvantages of the prior art by allowing antenna gain to be increased without increasing the antenna length (height) and without compressing the vertical beamwidth. This is accomplished by limiting the horizontal beamwidth of omni-directional antennae with the use of reflectors. By decreasing the horizontal angle of coverage of the omni-directional antenna, additional gain is achieved without sacrificing vertical beamwidth. Thus, at least four 16 dBd vertically L polarized antennae are formed by taking 10 dBd omni-directional antennae and adding reflectors to limit the horizontal beamwidth to 90°. The vertical beamwidth remains at 7°. Power combining hybrids connect each of the two opposed directional antennae. The output signal from the two hybrids is coupled to a diversity receiver where the amplitude and phase of the signals are adjusted and combined in a constructive manner.

The invention may combine N such directional antennae, where N is an even number $\leqq 2$, with each two opposing antenna outputs being coupled to a passive power combining hybrid. The output of each of the hybrids is then coupled to the diversity receiver.

Thus, the invention provides an improved system having enhanced antenna gain with the use of at least four directional antennae covering a 360° horizontal beamwidth sector and a fixed vertical beamwidth sector and where each individual antenna is arranged to cover no more than a 90° beamwidth sector. A power combiner (hybrid) is coupled to each opposed pair of antennae for combining the signals from the opposed antennae and a single channel diversity receiver is coupled to the hybrid combiners for optimally adjusting the phase and amplitude of each signal and combining the signals.

Each of the directional antennae comprises an omni-directional antenna and a reflector associated with each antenna to limit the horizontal beamwidth to no more than 90°.

In the general embodiment of the invention, at least N directional antennae covering 360° horizontal beamwidth sector and having a fixed vertical beamwidth sector are constructed such that each individual antenna is arranged to cover no more than a 360°/N beamwidth sector where N=an even number $\leqq 2$. Thus, N=2, 4, 6, 8 and the like.

Further, the equipment arrangement as disclosed herein, has a single channel (frequency) for each receiver. To accommodate multiple channels, a preamplifier/power splitter (multi-coupler) is needed for each signal lead from each combining hybrid feeding each diversity receiver.

SUMMARY OF THE INVENTION

Thus, in accordance with the present invention, a system having enhanced antenna gain comprises at least N directional antennae covering a 360° horizontal beamwidth sector, and having a fixed vertical beamwidth sector, each individual antenna arranged to cover no more than a 360°/N horizontal beamwidth sector where N=an even number $\leqq 2$, a power hybrid combiner coupled to each opposed pair of antenna for combining the signals from the opposed antennae and a single channel diversity receiver coupled to the output of the hybrid combiners for adjusting the phase and amplitude of each signal and combining the signals.

The invention also relates to a method for enhancing antenna gain comprising the steps of covering a 360° horizontal beamwidth sector having a fixed vertical beamwidth with at least N directional antennae, each individual antenna covering no more than a 360°/N horizontal beamwidth sector where N=an even number ≦2, coupling a power hybrid combiner to each opposed pair of antennae for combining the signals for the opposed antennae, and coupling a single channel diversity receiver to the hybrid combiners for adjusting the phase and amplitude of each signal and combining the signals.

DETAILED DESCRIPTION OF THE DRAWINGS

Figure 1:
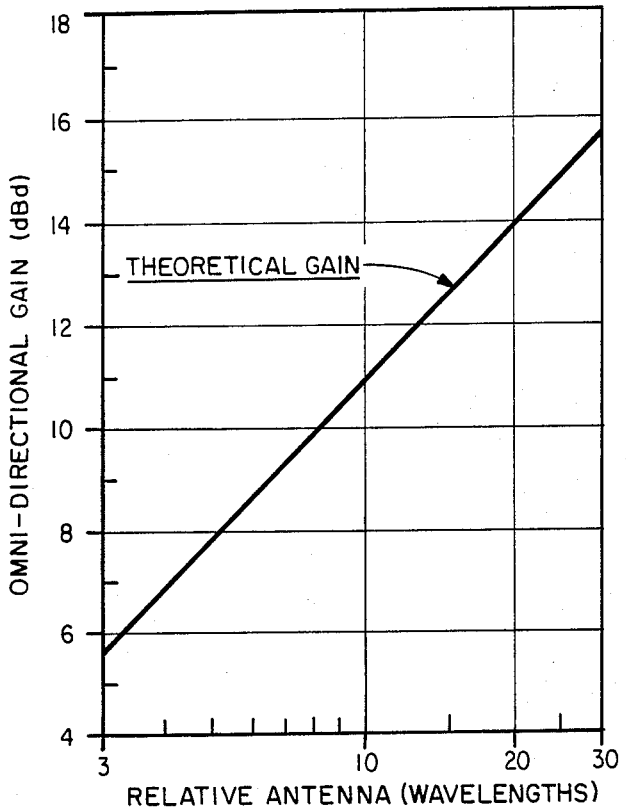
FIG. 1 is a graph illustrating the relationship of the antenna gain to relative antenna length and applies generally to commercial omni-directional antennae.

Omni-directional communication systems are well known in the art and efforts are continually made to improve their performance and maximize antenna gain. A desirable result from maximizing antenna gain would be the maximizing of the resulting carrier-to-noise ratio and carrier-to-interference ratio. It would seem obvious that to maximize omni-directional antenna gain that dipoles could be stacked in a collinear manner. However, there are two considerations which must be taken into account by this procedure. At frequencies below 100 MHz, a physical problem is created by stacking dipoles to achieve a gain of more than 4 dB. The power gain of an omni-directional, collinear antenna, in decibels with respect to that of a dipole, can be approximated by the expression for optimal spacing, $$G_{dbd}=10\log(2L/\lambda)-2.15 \quad (1)$$

where L is the length of the radiator and λ is the wave length, and 2.15 is the relationship in decibels (dB) between a dipole and an isotropic antenna. The result of this relationship as expressed by equation (1) is shown graphically in FIG. 1 and applies generally to commercial omni-directional antennae. The theoretical relationship graphed in FIG. 1 of the omni-directional gain versus the relative antenna length compares very closely to actual tests. It can be seen in FIG. 1 that omni-directional antenna gain does increase logarithmically with an increase in the relative antenna length. However, increasing the length of the antenna, itself, creates further problems. First, the Federal Communications Commission Regulations state that if the antenna, itself, extends more than twenty foot above the top of a tower, building or water tower, it will require aircraft warning lighting. This would involve decoupling networks and a side ladder for changing the lights and thus, are additional expenses that present electrical and mechanical problems.

Figure 2A:
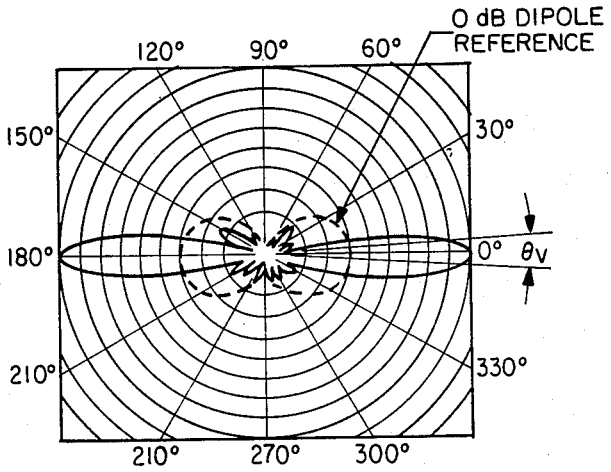
FIG. 2A is a graph illustrating the vertical profile of stacked vertical dipoles showing a reduced vertical beamwidth, $\theta_v$.

The second limitation on achieving higher gain by stacking dipoles in a collinear manner is that decreasing values of vertical beamwidths occur with an increase in antenna length. The half-power beamwidth for an antenna gain of 10 dB, for example, is only 7°. Omni-directional antenna gain is achieved by stacking dipoles at the expense of compressing the vertical beamwidth. The beamwidth decreases by a factor of 2 to achieve each increase in antenna gain of 3 dB. FIG. 2A is a graph illustrating a vertical profile of stacked vertical dipoles showing the reduced vertical bandwidth, $\theta_v$. As the vertical beamwidth narrows, the criticality of mounting the antenna and of maintaining the exact perpendicular position, even under wind loading, becomes more important. For the 10 dBd gain antenna, a movement of 3½° under high wind conditions will cause a loss in signal level of 3 dB. Thus, higher gain antennae formed in such a manner must be built in a more rugged or heavy fashion and have substantially more towers to support it. Further, as the vertical beamwidth narrows, the dead zone or cone of silence beneath the antenna increases. This produces more dead spots. Finally, phasing harnesses become more critical as the number of stacked elements increase. It is apparent, therefore, that antenna gain must be increased while maintaining a limitation on maximum antenna height and on minimum vertical beamwidth.

The theoretical gain at the center lobe of a directional antenna can be calculated if the half-power beamwidths are given by the vertical (elevation) and horizontal (azimuth) angles. The maximum gain over an isotropic radiator is calculated by dividing the area of the ellipse (or circle) of the radiation pattern at the half-power angles into the surface area of a sphere (4π square radians) as shown by $$G_i=4\pi/(\theta_H)(\theta_v) \quad (2)$$

where $G_i$=the maximum gain over an isotopic radiator, $\theta_H$ is the horizontal beamwidth in radians and $\theta_v$ is the vertical beamwidth in a plane at right angles. If the half-power beamwidths are expressed in degrees, then $$G_i=41{,}253/(\theta^\circ_H\times\theta^\circ_v) \quad (3)$$

Since a half-wave dipole has a gain of 1.64 (2.15 dB) over an isotropic radiator, the directional gain of an antenna at the center of the main lobe over a half-wave dipole is $$G_{dBd}=10\log_{10}[25{,}154/(\theta^\circ_H\times\theta^\circ_v)] \quad (4)$$

The theoretical maximum gain has assumed that there is no radiation off the back of the antenna or in spurious side lobes. Even if the side lobes are down 10 dB from the main lobe, the antenna gain will be incorrect only by two-tenths or three-tenths of a decimal. This also assumes good phase-combining by the many antenna elements over a reasonable bandwidth.

For the special case of a doughnut-type pattern of a simple dipole mounted vertically to achieve omni-directional coverage, the gain with reference to an isotropic antenna reduces to $$G_i=4\pi/(2\pi\theta_v)=2/\theta_v rad \quad (5)$$

and, expressed in degrees, this becomes $$G_i=114.6/\theta^\circ_v \quad (6)$$

Figure 2B:
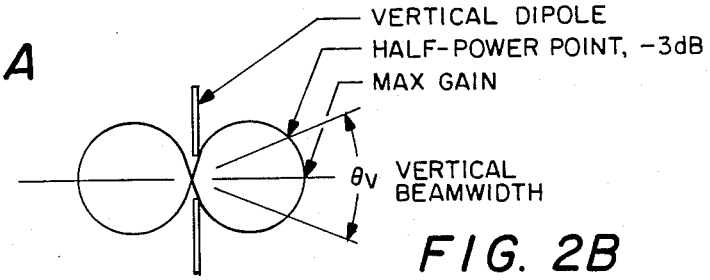
FIG. 2B represents the vertical profile of a dipole element illustrating the vertical beamwidth, $\theta_v$.

The vertical beamwidth, $\theta_v$, is determined by the half-power points, as shown in FIG. 2B. The maximum gain over an isotropic antenna for an omni-directional antenna at the center of the lobe, assuming 100% efficiency, is more closely approximated by $$GdBi=10\log_{10}[1/\sin(\theta^\circ_v/2)] \quad (7)$$

where $\theta_v$ is the full vertical beamwidth in degrees. The more common value is the gain reduced to a half-wave dipole as illustrated by $$G_{dBd}=(G_{dBi}-2.15)dBd \quad (8)$$

or $$G_{dbd}=10\log_{10}[0.61/\sin(\theta^\circ_v/2)]dBd \quad (9)$$

The Electronic Industry Association Standard RS-329 references all gain measurements to a half-wave dipole. To achieve this gain, no power can be spent in backward radiation or in spurious side lobes. If these lobes are 15 dB or more below the strength of the main lobe, the above formula is quite accurate.

Figure 3:
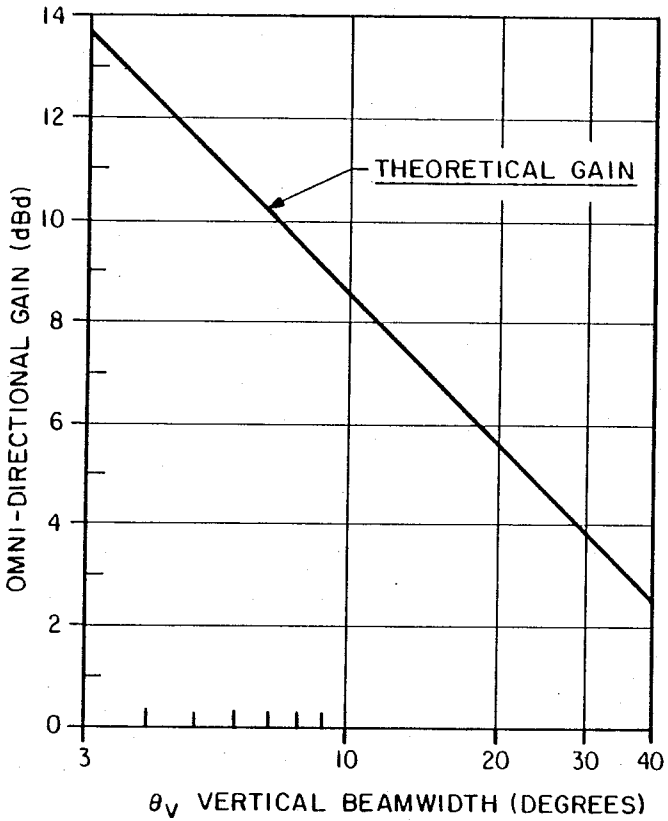
FIG. 3 is a graph illustrating omni-directional antenna gain as a function of vertical beamwidth as calculated theoretically.

As the gain of the antenna is increased by stacking dipole elements, the vertical beamwidth is decreased. The flattening of the vertical beamwidth with an increase in omni-directional antenna gain is illustrated theoretically in FIG. 3. A survey of commercial omni-directional antennae were compared with the theoretical and the agreement between the theoretical and practical is very good. Thus, the graph illustrated in FIG. 3 accurately represents the relationship between the gain of an omni-directional antenna and the vertical beamwidth. As more elements are added to the stacked dipoles, the classic doughnut-shape of the dipole flattens out to produce a disk.

Consider, now, the gain at the center of the main lobe of a 90° horizontal beamwidth directional antenna compared with the gain of a vertically polarized omni-directional antenna, assuming equal vertical capture angles for both antennae. The gain difference, G, is simply $$G(90^\circ\ \textit{directional antenna over omni})=10\log(360^\circ/90^\circ)=6.02\ dB \quad (10)$$

Figure 4:
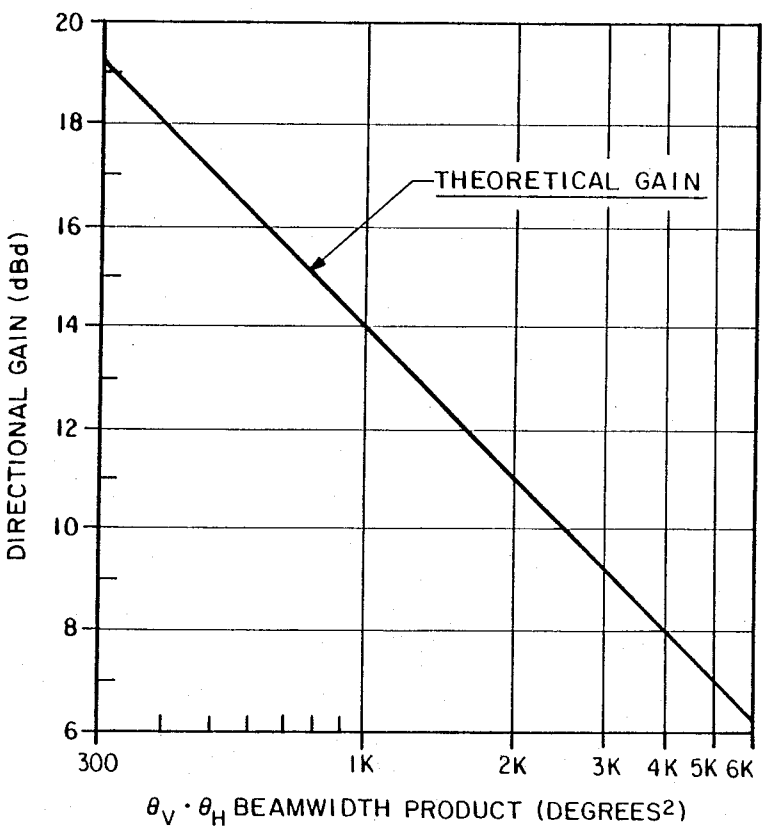
FIG. 4 is a graph illustrating the directional gain of an omni-directional antenna as a function of the product of the vertical and horizontal beamwidths.

Thus, it can be seen that by decreasing the horizontal angle of coverage of the omni-directional antenna, additional gain can be achieved without sacrificing vertical beamwidth. This is clear from the above formulas where the product of the vertical and horizontal beamwidth determines the antenna gain as shown in FIG. 4 theoretically. This graph includes vertical antennae with 30° to 180° of horizontal beamwidth and represents all types of antennae such as Yagis, corner reflectors, dipoles, stacked collinear dipoles, panels and collinears with reflectors.

Figure 5:
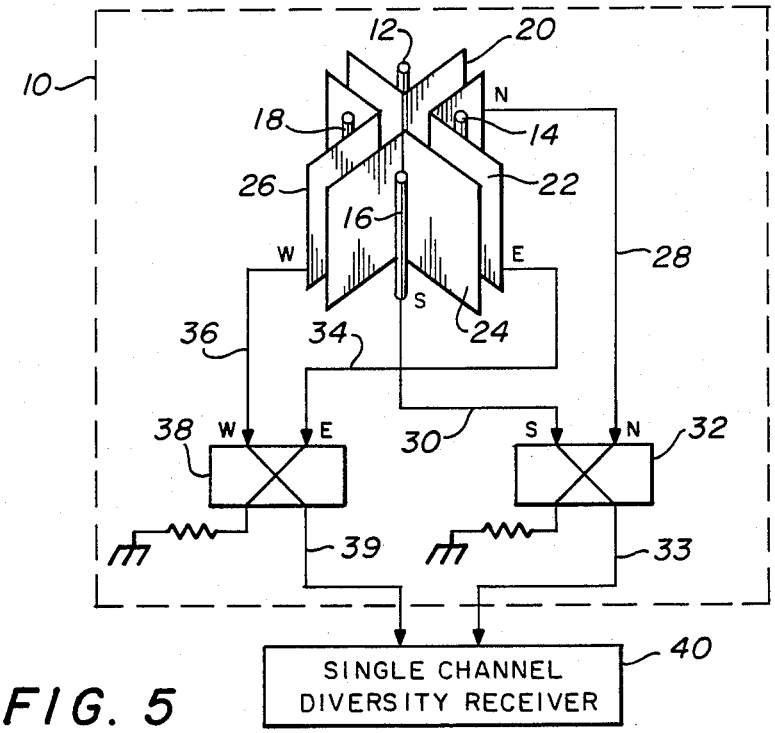
FIG. 5 is a schematic representation of the present invention employing four omni-directional antennae and associated reflectors and power combining hybrids to connect two opposing 16 dB, 90° horizontal beamwidth antennae together and coupling the output of the hybrids to a single channel diversity receiver.

The concepts set forth above are used in the present invention. In its simplest form, the invention entails the use of four directional antennae and two passive power combining hybrids. In FIG. 5, the enhanced antenna array 10 includes the four directional antennae 12, 14, 16 and 18 each of which has a corresponding added reflector 20, 22, 24 and 26 to limit the horizontal beamwidth of each antenna to 90°. The vertical beamwidth remains at 7°.

The two opposing antennae 12 and 16 are coupled through conductors 28 and 30 to a 3 dB power combining hybrid 32. In like manner, the other two opposing antennae 14 and 18 are coupled through conductors 34 and 36 to 3 dB power combining hybrid 38. A 3 dB loss in each of the combiners 32 and 38 can be assumed because the incoming signal from a mobile in any one antenna will not appear in the nonadjacent (back side) antenna. The front-to-back ratio of the antenna is typically greater than 20 dB, therefore, the antenna doesn't see anything from its backside. Thus, the excess gain over a 10 dB omni system, assuming equal elevation beamwidths, is represented by the expression

*Excess Gain = Antenna Gain With Reflection − Original Antenna Gain − Loss of Hybrid*

Thus, excess antenna gain, $G_E$, is represented as $$G_E=16.02\ dBd-10\ dBd-3.01\ dBd=3.01\ dBd \quad (11)$$

The effective antenna gain is thus equal to the directional antenna gain, minus the omni-directional antenna gain, minus the hybrid loss. The vertical beamwidth and physical height of the antenna have been preserved and the gain increased at the cost of a little antenna complexity.

The two power combining hybrids 32 and 38 feed a diversity receiver 40. At VHF frequencies and above diversity receivers are typically used to combat multipath effects. There are basically three types of diversity combining systems in practical use. They are selection diversity, maximal-ratio diversity and equal gain diversity systems. The diversity combiner effectively adjusts the amplitude and phase of each signal to combine the two signals in a constructive manner.

Figure 6:
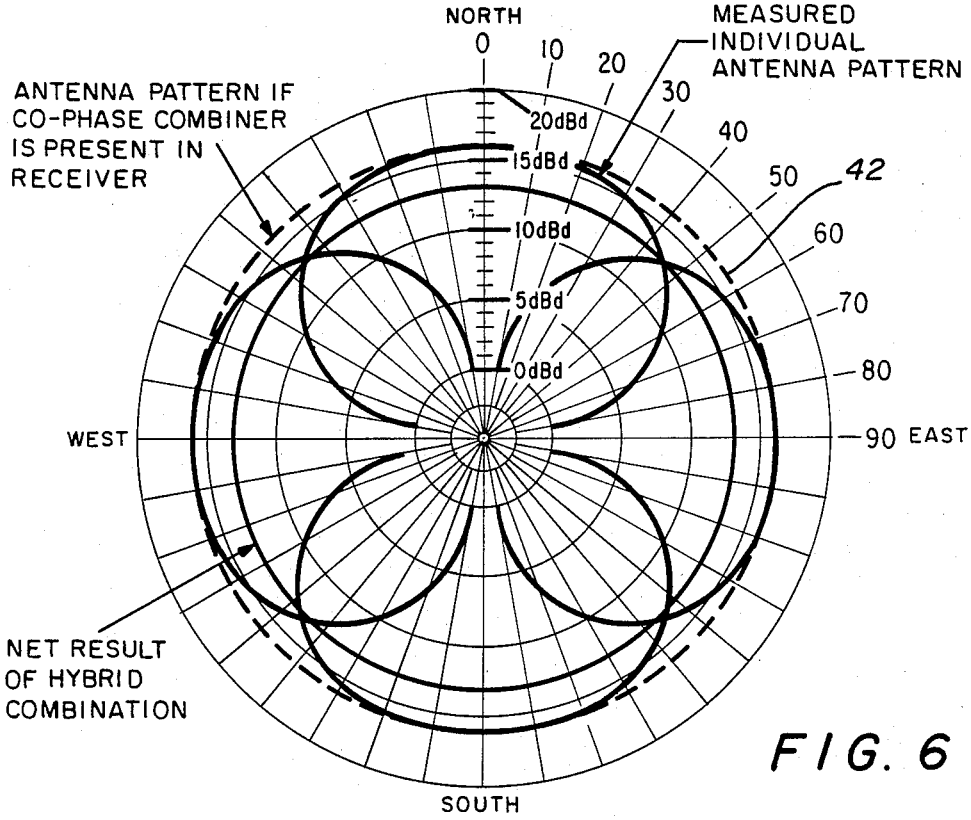
FIG. 6 is a graph illustrating the individual patterns of the 16 dBd directional antennae with the dotted line showing the effective omni-directional pattern achieved by a coherent co-phase combiner.

The horizontal antenna pattern shown in FIG. 6 illustrates the individual patterns of the four 16 dBd directional antennae. The dotted line 42 illustrates the effective omni-directional pattern achieved by a coherent co-phase combiner. The net result is reduced by the hybrid power combiner 32 and 38 to 13 dBd.

Figure 8:
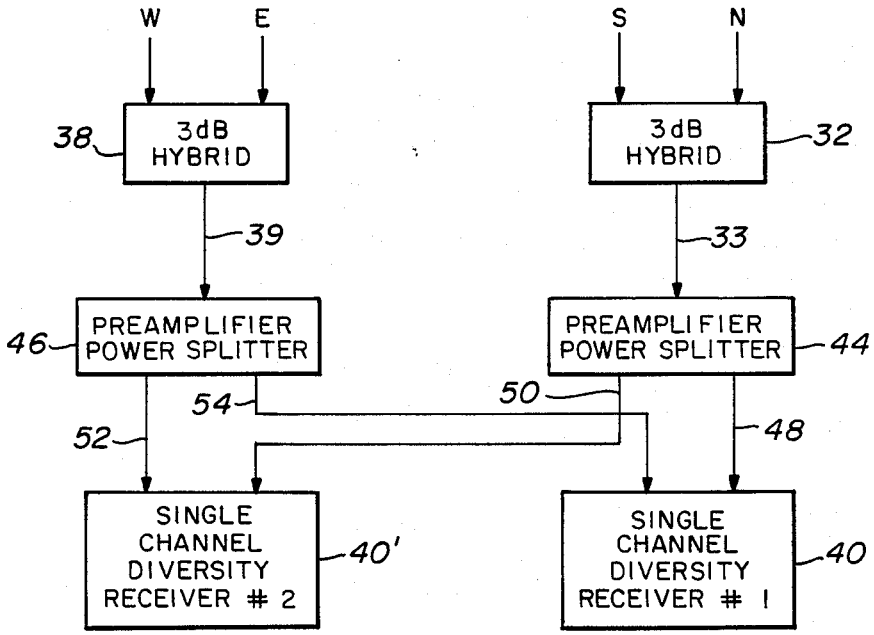

The equipment arrangement shown in FIG. 5 is for a single channel (frequency) for each receiver. To accommodate multiple channels, a preamplifier/power splitter (multi-coupler) is needed for each signal lead feeding each diversity receiver. Thus, as can be seen in FIG. 8, the hybrids 32 and 38 are identical to those illustrated in FIG. 5 and generate outputs on lines 33 and 39 to preamplifier/power splitter 44 and 46, respectively. Splitter 44 produces first output on line 48 which is coupled to diversity receiver 40 and a second output on line 50 which is coupled to a second single channel diversity receiver 40'. In like manner, preamplifier/-power splitter 46 generates a first output on line 52 which is coupled to second diversity receiver 40' and a second output on line 54 which is coupled to the first diversity receiver 40. Thus, two channels are shown in FIG. 8. However, more channels could be added by coupling further outputs from the power splitters to additional single channel diversity receivers.

Figure 7:
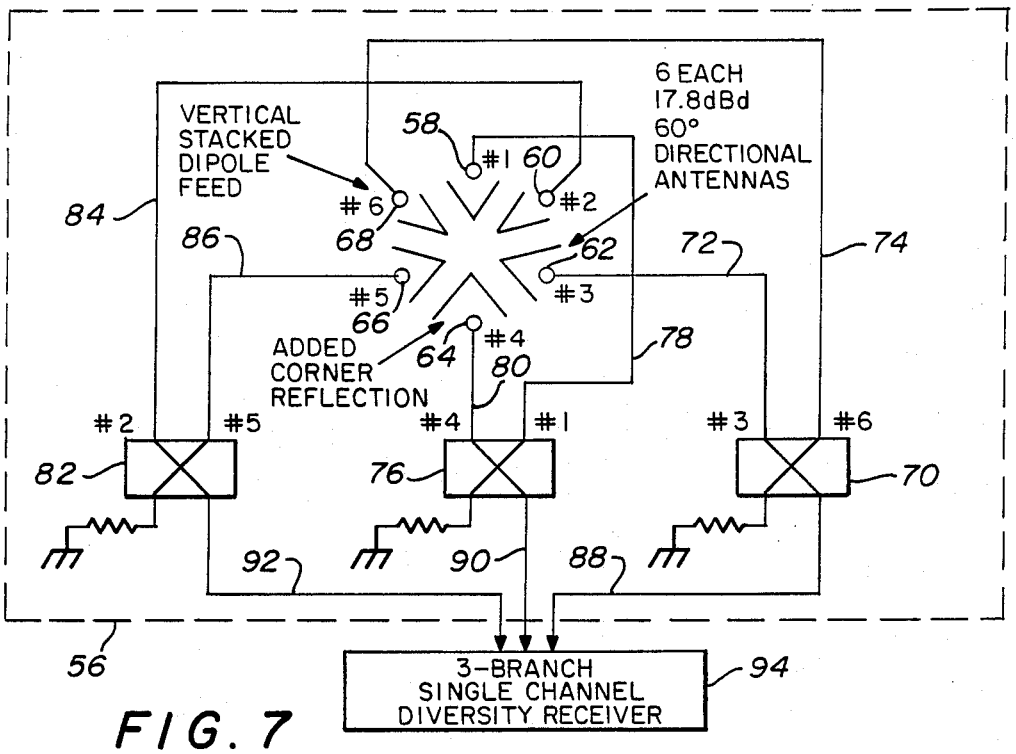
FIG. 7 is a schematic representation of the invention where six antennae are used.

FIG. 7 illustrates the natural progression of the enhanced antenna gain concept shown for the case of six receiving antennae. The effective gain over an omni-directional system is equal to $$G_E=[10 \log 10(N)-3.01]dBd \quad (12)$$

where N is the number of directional antennae and 3.01 dB is the loss in an equal-split power divider (3 dBd hybrid). For a six antenna system as shown in FIG. 7, the excess gain, $G_E$, offered over a nominal 10 dBd omni-directional receiver system is shown by the equation $$G_E=[10 \log (6)-3.01]=4.77\ dBd \quad (13)$$

If each antenna horizontal beamwidth is limited to 10°, the excess gain of a 36 antenna array is $$G_E=[10 \log (36)-3.01]=12.6\ dBd \quad (14)$$

The above analysis represents an omni-directional antenna system. If the need for sector coverage is less, the principal works the same. If it is desired to limit the coverage to a certain sector for geographical or political reasons, the same techniques of combining can be used over that reduced coverage area.

It is also noted that in such case, the carrier-to-interference ratio would improve due to the reduced probabilistic chances that the interference (electrical noise or another contending mobile) exists in an unused quadrant.

Once the relative angle of the mobile is extracted from the receiving system, this information can be used for a switched, phase and amplitude adjusted, antenna system for increasing effective transmitted power while maintaining a wide vertical beamwidth and a limited height.

Although the invention has been discussed, at this point, with respect to four antennae, it can be actually be used with an array. FIG. 7 discloses such an array where N=6. The enhanced antenna array 56 of FIG. 7 includes six omni-directional antennae 58, 60, 62, 64, 66 and 68. Since there are six antennae, the reflectors must be constructed so as to limit the horizontal radiation beamwidth of each antenna to 360°/6 or 60°. Therefore, each of the antenna 58 through 68 becomes a directional antenna which radiates in a horizontal beamwidth of 60°. Hybrid 70 receives the outputs from opposed antennae 62 and 68 on lines 72 and 74, respectively. Power combiner hybrid 76 receives the outputs of opposing antennae 58 and 64 on lines 78 and 80, respectively. Power combiner network 82 receives the output from opposing antennae 60 and 66 on lines 84 and 86, respectively, and combines them. The hybrid combiners 70, 76 and 82 generate outputs on lines 88, 90 and 92, respectively, which are coupled to the three branch single channel diversity receiver 94. Thus, while FIG. 7 is illustrative only, it can be seen that any number of antennae, N, can be used in such configuration where N is an even number ≧2.

Thus, there has been disclosed a novel antenna system and method in which antenna gain is increased while maintaining a limitation on maximum antenna height and on minimum vertical beamwidth. The invention yields enhanced gain over conventional antenna systems by taking advantage of cleverly combining directional antennae. While the simplest embodiment entails the use of four directional antennae and two passive power combining hybrids, the invention encompasses the use of N directional antennae and N/2 passive power combining hybrids. Each hybrid connects two opposing (10+10 log N) dB gain, 360/N horizontal beamwidth antennae together. Each vertically polarized antenna is formed by taking a 10 dBd omni-directional antenna and adding a reflector to limit the horizontal beamwidth to 360°/N. Where N=6, for example, the horizontal beamwidth is limited by the reflector to 60° and the gain of each antenna is 17.8 dB. Where N=4, the reflector limits the horizontal beamwidth to 90°, and the gain of each antenna is 16 dB. In all cases, the vertical beamwidth however remains fixed at 7°.

While the invention has been described in connection with a preferred embodiment, it is not intended to limit the scope of the invention to the particular form set forth, but, on the contrary, it is intended to cover such alternatives, modifications and equivalence as may be included within the spirit and scope of the invention as defined in the appended claims.

I claim:

1. An antenna system having enhanced gain comprising:

at least N directional antenna combining to cover a 360° horizontal beamwidth sector and having an established vertical beamwidth, each individual antenna including an omni-directional antenna and a reflector element to limit the horizontal beamwidth of the associated omni-directional antenna to cover no more than a 360°/N beamwidth sector where N=an even number ≧2;

a power combiner hybrid coupled to each opposed pair of antennae for combining the signals from the opposed antennae; and a single channel diversity receiver coupled to the power combiner hybrids for adjusting the phase and amplitude of the signal from each combiner hybrid for constructively combining the signals.

2. A system in claim 1 wherein N=4.

3. A system in claim 1 wherein N=6.

4. A system as in claim 1 wherein each reflector limits the horizontal beamwidth of its associated antenna to no more than 90° without disturbing the vertical beamwidth.

5. An antenna system having enhanced gain comprising:

at least N directional antennae combining to cover a 360° horizontal beamwidth and having an established vertical beamwidth, each individual antenna including an omni-directional antenna and a reflector element to limit the horizontal beamwidth of the associated omni-directional antenna to cover no more than a 360°/N beamwidth sector where N=an even number ≧2;

a power combiner hybrid coupled to each opposed pair of antennae for combining the signals from the opposed antennae;

a power splitter coupled to the output of each combiner hybrid and producing at least n output signals where n=the number of frequencies to be received;

n single channel diversity receivers individually coupled to one of said at least n output signals from each power splitter to accommodate one of the n frequencies.

6. A system as in claim 5 wherein n=2.

* * * * *

UNITED STATES PATENT AND TRADEMARK OFFICE

CERTIFICATE OF CORRECTION

PATENT NO. : 4,983,988

DATED : January 8, 1991

INVENTOR(S) : Ernest A. Franke

It is certified that error appears in the above-identified patent and that said Letters Patent is hereby corrected as shown below:

On the title page, item [75] Inventor: "Ernest A. Franke" should be changed to --Earnest A. Franke--.

Column 2, line 6, delete "L".
Column 8, line 5, change "an array" to --an N array--.

Signed and Sealed this

Third Day of November, 1992

*Attest:*

DOUGLAS B. COMER

*Attesting Officer*

*Acting Commissioner of Patents and Trademarks*